US005764194A

United States Patent [19]

Brown

[11] Patent Number: 5,764,194

[45] Date of Patent: Jun. 9, 1998

[54] ANTENNA ORIENTATION ASSEMBLY

[75] Inventor: Ronald Lanier Brown, Glassboro, N.J.

[73] Assignee: Thomson Consumer Electronics, Inc., Indianapolis, Ind.

[21] Appl. No.: 577,245

[22] Filed: Dec. 22, 1995

[51] Int. Cl.[6] ..... H01Q 21/00

[52] U.S. Cl. ..... 343/726; 343/741; 343/901

[58] Field of Search ..... 343/702, 725, 343/726, 727, 728, 741, 742, 792, 901, 906, 765, 882, 880, 881

[56] References Cited

U.S. PATENT DOCUMENTS

| | | | |
|---|---|---|---|
| 1,567,542 | 12/1925 | Pickard . | |
| 1,679,240 | 7/1928 | Sanyi . | |
| 1,741,185 | 12/1929 | Fleming . | |
| 2,536,733 | 1/1951 | Finke et al. | 250/33 |
| 2,657,312 | 10/1953 | Saranga | 343/744 |
| 2,833,849 | 5/1958 | Abel | 174/153 |
| 2,834,015 | 5/1958 | Carpenter | 343/876 |
| 2,946,842 | 7/1960 | Chadowski | 174/153 |
| 3,138,661 | 6/1964 | Grashow | 174/153 |
| 3,181,163 | 4/1965 | Kozlow et al. | 343/882 |
| 3,478,361 | 11/1969 | Middlemark | 343/742 |
| 3,508,274 | 4/1970 | Kesler et al. | 343/758 |
| 3,579,241 | 5/1971 | Antista et al. | 343/702 |
| 3,587,101 | 6/1971 | Nienaber | 343/702 |
| 3,653,051 | 3/1972 | Wu | 343/741 |
| 3,683,392 | 8/1972 | White | 343/805 |
| 3,739,388 | 6/1973 | Callaghan | 343/726 |
| 5,218,370 | 6/1993 | Blaese | 343/702 |
| 5,248,986 | 9/1993 | Marshall | 343/715 |
| 5,552,796 | 9/1996 | Diamond | 343/882 |

OTHER PUBLICATIONS

Photographs 1–4: Various views of "Tecoton" antenna believed to have been on sale in the U.S. before Dec. 22, 1995.

Photograph 5: RCA Premier Indoor Antenna (ANT130) believed to have been on sales in the U.S. before Dec. 22, 1995.

*Primary Examiner*—Donald T. Hajec
*Assistant Examiner*—Tan Ho
*Attorney, Agent, or Firm*—Woodard, Emhardt, Naughton, Moriarty & McNett

[57] ABSTRACT

An antenna orientation device which includes a base, an antenna structure with a first bearing surface, and a support for positioning the structure in relation to the base. The support includes a body coupled to the base and having a stem. The support also includes a resilient non-metallic bearing member carried on the stem which has a second bearing surface. The support also includes a fastener connected to the body for clamping the first and second bearing surfaces in rotary bearing relation. The bearing member is elastically deformed to provide retaining force sufficient to hold the structure against earth's gravitational pull in any one of a range of rotational positions about a substantially non-vertical axis. Each position within the range is selectable by rotating the structure by hand. This support can provide a rotational range of at least 45 degrees. The fastener may be configured as an adjustable screw to provide a way to vary retaining force.

32 Claims, 4 Drawing Sheets

ANTENNA ORIENTATION ASSEMBLY

BACKGROUND OF THE INVENTION

A. Field of the Invention

The present invention relates to indoor antenna systems and, more particularly, to an indoor antenna assembly for variably positioning an antenna reception element.

B. Prior Art

Presently, there exists a number of antenna systems designed for indoor use which have relatively limited reception capability in both the UHF and VHF range. These limitations result from the fact that the antenna elements have to be made relatively compact in order to assure that the assembly does not occupy an undue amount of space. Due to the fact that indoor antennas typically must be capable of receiving the entire VHF and UHF bands, such antennas have conventionally been designed so that they can be oriented in a desired position to maximize reception. Often, this adjustment may be accomplished by hand.

One prior art antenna in wide use today is the UHF loop antenna disclosed in U.S. Pat. No. 3,233,340. This antenna utilizes a pair of continuous wire turns to couple the loop shaped reception element to a pair of conductors. These wire couplings facilitate adjustment of the reception element to a desired position. However, many people consider the wire coupling elements to be generally unattractive and shorting occurs if the coupling elements touch one another. Further, the reception element generally must be made of a stiff wire capable of retaining a desired loop shape over the range of adjustable positions. In contrast, it would be desirable to use less expensive wire for an antenna if the proper loop shape can otherwise be retained.

Other types of antenna holding assemblies are shown in U.S. Pat. Nos. 3,181,163 and 5,218,370. These assemblies require several parts, including a metallic helical spring structure, to provide an adjustable antenna mount. This structure introduces considerable complexity to the device and may present a problem regarding electrical isolation of various metallic parts from the conductive reception element.

Several existing designs also disclose a base having multiple antennae which may be rotatably oriented over a given range. For example, U.S. Pat. Nos. 3,739,388, 2,683,392, 3,508,274, and 3,478,361 show several of these designs. Typically, these devices rest on top of a television and are electrically connected to it to improve reception. Some of these devices provide a mechanism to rotate the reception element to a desired position. Unfortunately, these devices still rely on the stiffness of a conductive antenna element to retain a desired loop shape. Another drawback is that these devices often do not facilitate rotational positioning about each of two different rotational axes with at least one axis being substantially non-vertical. Indeed, reliably maintaining the position of an antenna structure about a non-vertical axis requires a retaining force sufficient to hold it against the earth's gravitational pull.

With any of these structures, it is often desirable to adjust the holding force. Such adjustments compensate for the reduction of retention ability as the coupling components wear over time. Most existing antenna assemblies do not facilitate this adjustment capability.

Consequently, a need remains for an antenna support which reliably clamps the antenna structure in a desired rotational position about a substantially non-vertical axis and permits adjustment of the antenna structure by hand.

Moreover, the assembly should be capable of retaining a moveable antenna structure, which includes a flexible antenna wire and a housing enclosing and supporting the wire, in a desired loop configuration. If desired, the structure should offer a way to adjust the retaining force necessary to hold the antenna structure in a selected position. Furthermore, the antenna support should be capable of incorporation into in a multiple axis antenna orientation device.

SUMMARY OF THE INVENTION

One aspect of the present invention is to provide an antenna orientation device which includes a base, an antenna structure with a first bearing surface, and a support for positioning the structure in relation to the base. The support includes a body coupled to the base which has a stem. The support also includes a resilient non-metallic bearing member carried on the stem which has a second bearing surface. A fastener connected to the support body clamps the first and second bearing surfaces in rotary bearing relation. The bearing member is elastically deformed to provide retaining force sufficient to hold the structure against earth's gravitational pull in any one of a range of rotational positions about a substantially non-vertical axis. Each position within the range is selectable by rotating the structure by hand.

Another aspect of the present invention is an antenna orientation device that includes a base, a conductive wire antenna with a first lead portion and a second lead portion, and a hollow non-conductive conduit supporting the antenna in a loop shape which has a mounting tab. Furthermore, the device includes a coupling support for selectively orienting the conduit relative to the base. This support has a first rotary connection to the base for selective rotation of said support about a first axis and a second rotary connection to the mounting tab for selective rotation of the conduit about a second axis which is generally perpendicular to the first axis.

One primary object of the present invention is to provide a reliable and simple antenna orientation device which holds an antenna structure in a desired rotational position and may be repositioned by hand.

Another object of the present invention is an antenna coupling system which provides for adjustment of the clamping forces used to hold the antenna structure.

Yet a further object of the present invention is to hold an antenna structure in a desired rotational position where the structure includes an antenna wire and a housing to support the wire in a loop configuration.

Other objects of the present invention will be apparent from the drawings and detailed description provided herein.

DESCRIPTION OF THE PREFERRED EMBODIMENT

Figure 1:
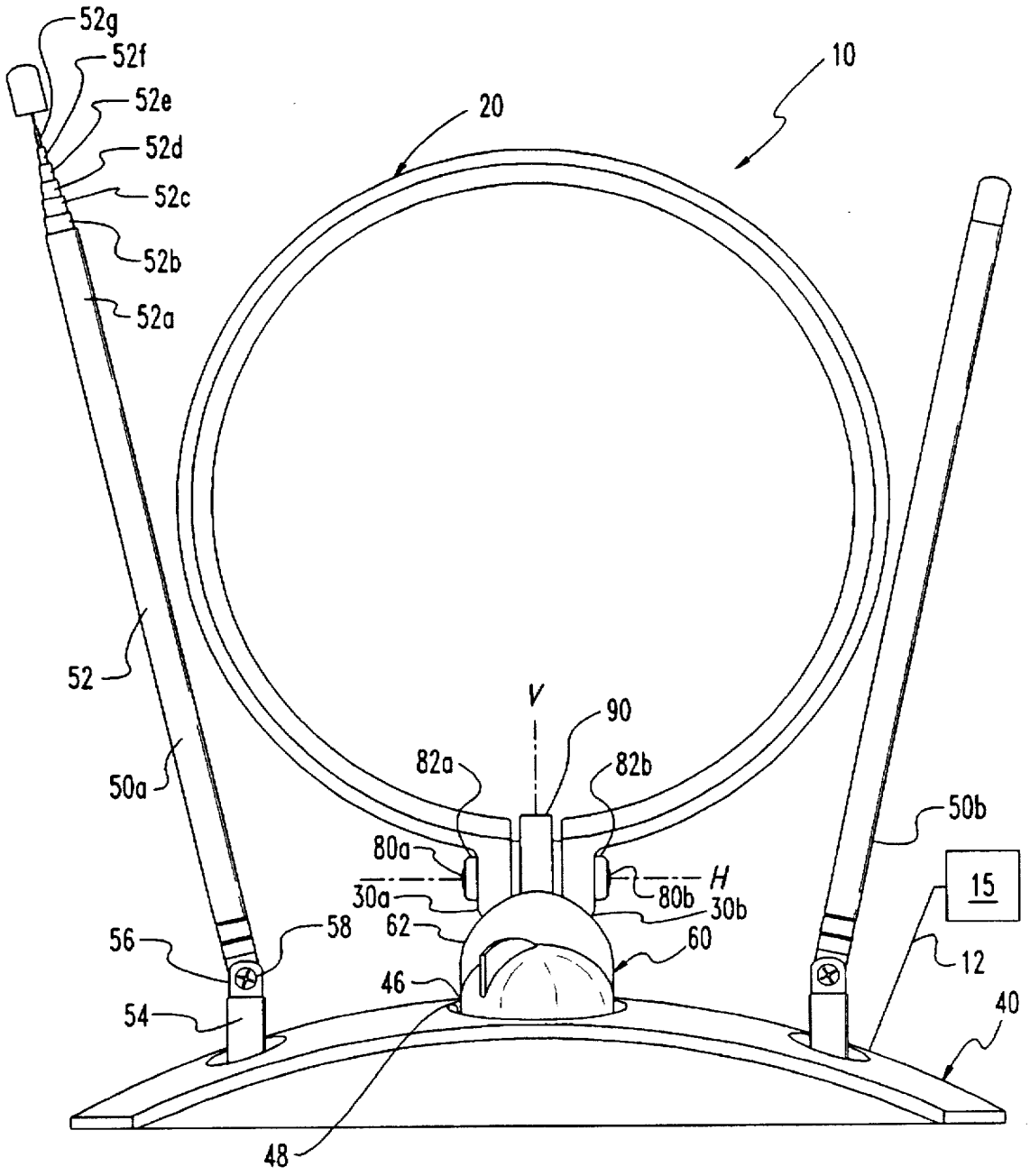
FIG. 1 is a front elevational view of one embodiment of the antenna assembly of the present invention with a schematic representation of a television connection.

For the purposes of promoting an understanding of the principles of the invention, reference will now be made to the embodiment illustrated in the drawings and specific language will be used to describe the same. It will nevertheless be understood that no limitation of the scope of the invention is thereby intended, any alterations or further modifications in the illustrated device, and further applications of the principles of the invention as illustrated therein being contemplated as would normally occur to one skilled in the art to which the invention relates.

FIG. 1 illustrates an antenna assembly 10 of the present invention. Antenna assembly 10 includes antenna structure 20 coupled to base 40 by coupling support 60. Notably, antenna structure 20 may be oriented by hand in any one of a number of rotational positions about axis H. The force necessary to retain antenna structure 20 in a selected position can be adjusted by loosing or tightening the screws 80*a* and 80*b*. Also, support 60 can be turned about axis V to a selected position by rotating support body 62. Antenna system 10 is electrically coupled to television 15 by line 12 to improve reception. Television 15 is of a known configuration. In alternate embodiments, antenna system 10 may be employed with other devices.

Figure 2:
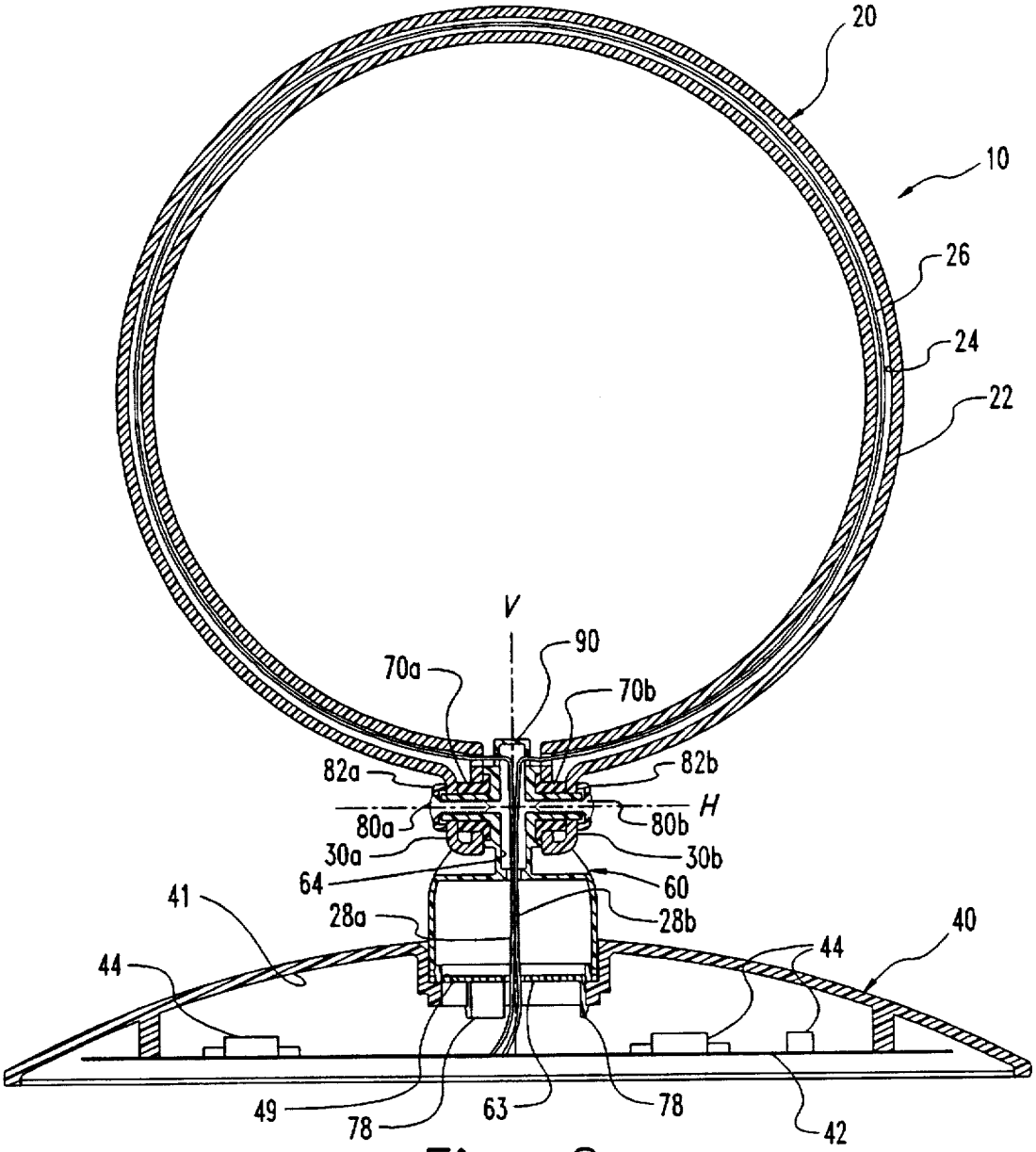
FIG. 2 is a cross-sectional view of the embodiment shown in FIG. 1.

Referring to FIG. 2 as well as FIG. 1, additional detail concerning antenna assembly 10 is depicted. Antenna structure 20 includes a conduit 22 which has mounting tabs 30*a* and 30*b* coupled to support 60. Conduit 22 defines a passage 24. Antenna structure 20 also includes a flexible wire antenna 26 received along passage 24. Conduit 22 encloses and supports wire 26 in a generally circular loop shape. Conduit 22 is preferably made from a thermoplastic material and provides a tubular housing for antenna wire 26; however, other configurations are contemplated as would occur to one skilled in the art.

As used herein, "antenna structure" means the conductive antenna element and any other components which are necessary to maintain the conductive element in a desired geometric shape over its range of selectable positions. Under this definition, a self-supporting conductive antenna element, such as a rigid wire which has no other components or housing structure, is an antenna structure. Also, an antenna structure includes any non-conductive component which supports the conductive element in a desired loop shape whether or not it encloses the conductive element. For example, one antenna structure includes a non-conductive disk with a conductive antenna wire running along the outer perimeter of the disk. Furthermore, as used herein, an "antenna loop" may have an elliptical, bow tie, rabbit ear, serpentine, or other shape, as would occur to those skilled in the art.

Antenna wire 26 has conducting lead portions 28*a* and 28*b*. Support body 62 of support 60 defines pathway 64 for receiving lead portions 28*a*, 28*b* therethrough. Base 40 defines a cavity 41 which includes a circuit board 42. Lead portions 28*a*, 28*b* are electrically coupled to circuit board 42. Circuit board 42 has a plurality of electronic components 44 for conditioning a signal from antenna wire 26. Circuit board 42 may have a means for coupling antenna assembly 10 to a device such as television 15 shown in FIG. 1. Support body 62 and base 40 may be made from a non-conductive plastic material.

Support body 62 has a central member 90 opposite base end portion 63. Base end portion 63 is generally cylindrical and is configured to engage annular seat 49 of base 40. Base end portion 63 is attached to resilient interlocking teeth 78 which protrude downwardly from base end portion 63. Teeth 78 are configured to snap into place to snugly secure base end portion 63 against seat 49. However, this coupling permits rotation of the support 60 about the generally vertical axis V. In one embodiment, three teeth 78 are equally spaced along the edge of base end portion 63 and are manufactured from a self-lubricating material such as nylon.

Base 40 includes a central knob 46 to adjust electronic conditioning of a signal received from antenna wire 26. Also, base 40 includes cylindrical dipole antennae 50*a*, 50*b*. Because dipole antennae 50*a*, 50*b* are generally the same, only one is described in detail for clarity. Specifically, antenna 50*a* includes an elongated arm 52 comprised of a number of concentric telescoping cylinder segments 52*a*, 52*b*, 52*c*, 52*d*, 52*e*, 52*f* and 52*g*. Arm 52 is coupled to base 54 by a clevis 56 using screw 58.

Figure 3A:
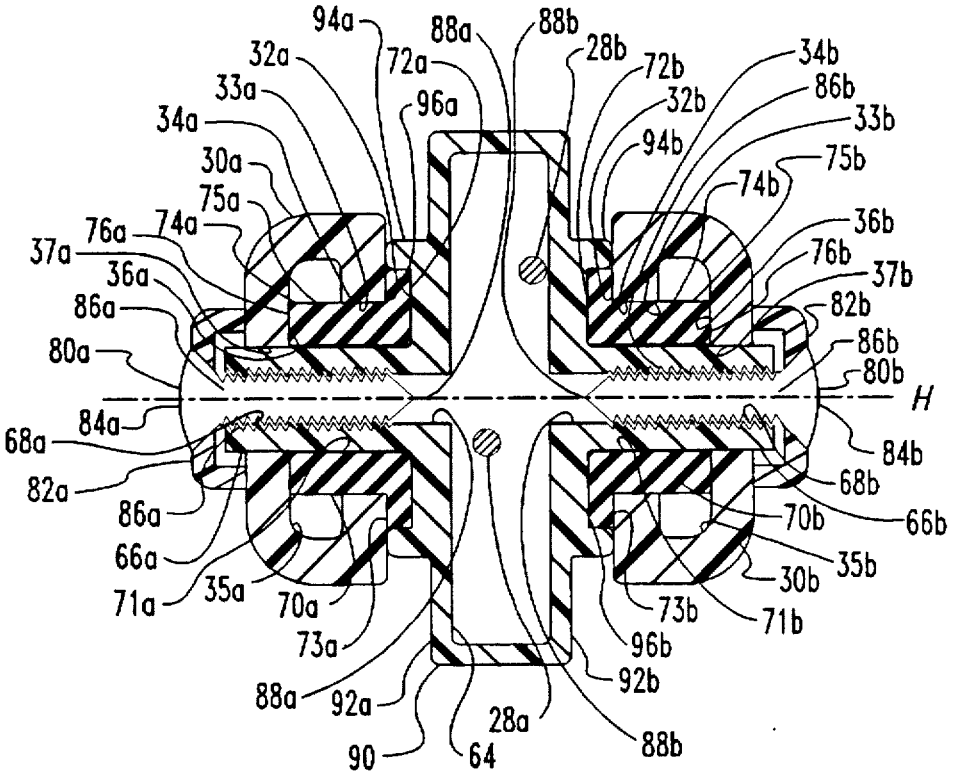
FIG. 3A is a top sectional view of the coupling support shown in FIGS. 1 and 2.
Figure 3B:
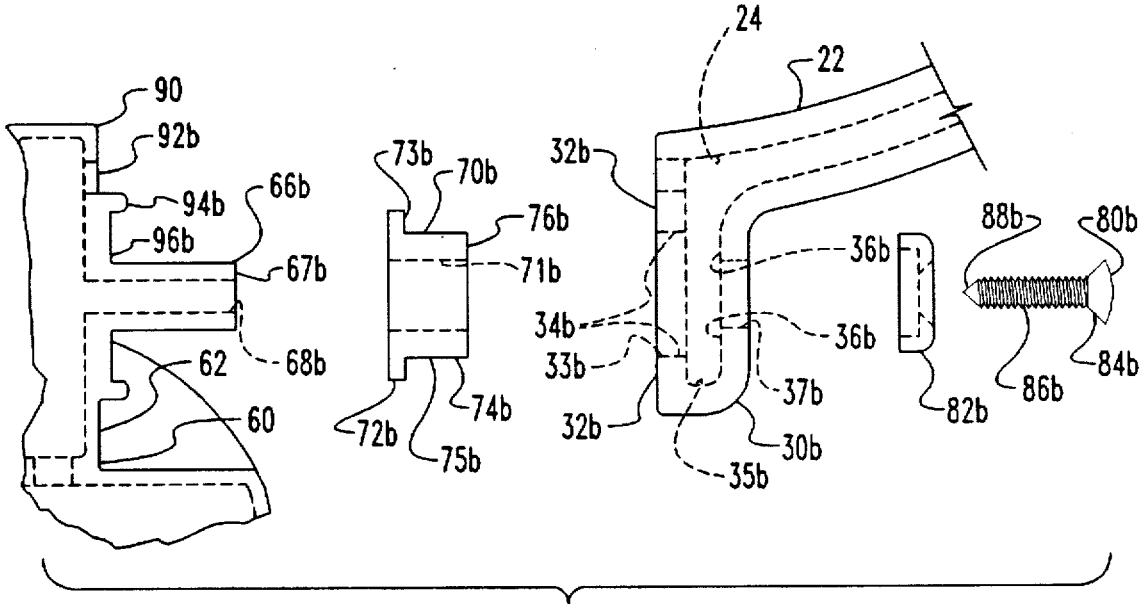
FIG. 3B is an exploded partial side view of the coupling support shown in FIGS. 1 and 2.

FIGS. 3A and 3B show details concerning the rotatable coupling of antenna structure 20 with coupling support 60. Specifically, FIG. 3A illustrates a sectional view of coupling support 60 in a view plane perpendicular to axis V of FIG. 2. FIG. 3B depicts an exploded view of a portion of the elements shown in FIG. 3A from the view plane of FIGS. 1 and 2. FIG. 3B does not show those elements having a reference numeral which ends in "a." However, those elements not shown in FIG. 3B generally correspond to the mirror image of those elements which are shown and have a reference numeral ending in "b."

Central member 90 includes opposing surfaces 92*a*, 92*b* with cylindrical stems 66*a* and 66*b* projecting therefrom. Coupling support 60 also includes annular resilient bearing members 70*a*, 70*b* which each have a central bore 71*a*, 71*b* for receiving a corresponding stem 66*a*, 66*b*. Each resilient bearing member 70*a*, 70*b* has a flange portion 72*a*, 72*b* and a barrel portion 74*a*, 74*b* which extends toward resilient bearing member end face 76*a*, 76*b*. Correspondingly, each flange portion 72*a*, 72*b* has a flange surface 73*a*, 73*b* and each barrel portion 74*a*, 74*b* has an outer circumferential surface 75*a*, 75*b*. Preferably resilient bearing members 70*a*, 70*b* are made from a highly resilient rubber material which is softer and less stiff than the other support 60 components or mounting tabs 30*a*, 30*b*. In one preferred embodiment, it is preferred that resilient bearing members 70*a*, 70*b* have a durometer hardness in the range of about 50 to 60.

Each mounting tab 30*a*, 30*b* is configured to engage a resilient bearing member 70*a*, 70*b* correspondingly disposed upon stem 66*a*, 66*b*. Each mounting tab 30*a*, 30*b* has an inner contact surface 32*a*, 32*b* each configured to contact a corresponding flange surface 73*a*, 73*b*. Each contact surface 32*a*, 32*b* defines an inner aperture 33*a*, 33*b* therethrough. Also, each mounting tab 30*a*, 30*b* has an outer contact surface 36*a*, 36*b* configured to contact a corresponding resilient bearing member end face 76*a*, 76*b*. Each outer contact surface 36*a*, 36*b* defines an outer aperture 37*a*, 37*b* therethrough. Inner apertures 33*a*, 33*b* and outer apertures 37*a*, 37*b* intersect coupling space 35*a*, 35*b* each of which intersects passage 24 of conduit 22.

Each stem 66*a* , 66*b* has an end surface 67*a*, 67*b* defining a threaded bore 68*a*, 68*b* for receiving a corresponding threaded stem 86*a*, 86*b* of screws 80*a*, 80*b*. Each screw 80*a*, 80*b* has a head 84*a*, 84*b* opposing a screw end 88*a*, 88*b*. Each washer 82*a*, 82*b* is correspondingly configured to engage each head 84*a*, 84*b* and mounting tabs 30*a*, 30*b*, respectively.

Figure 4:
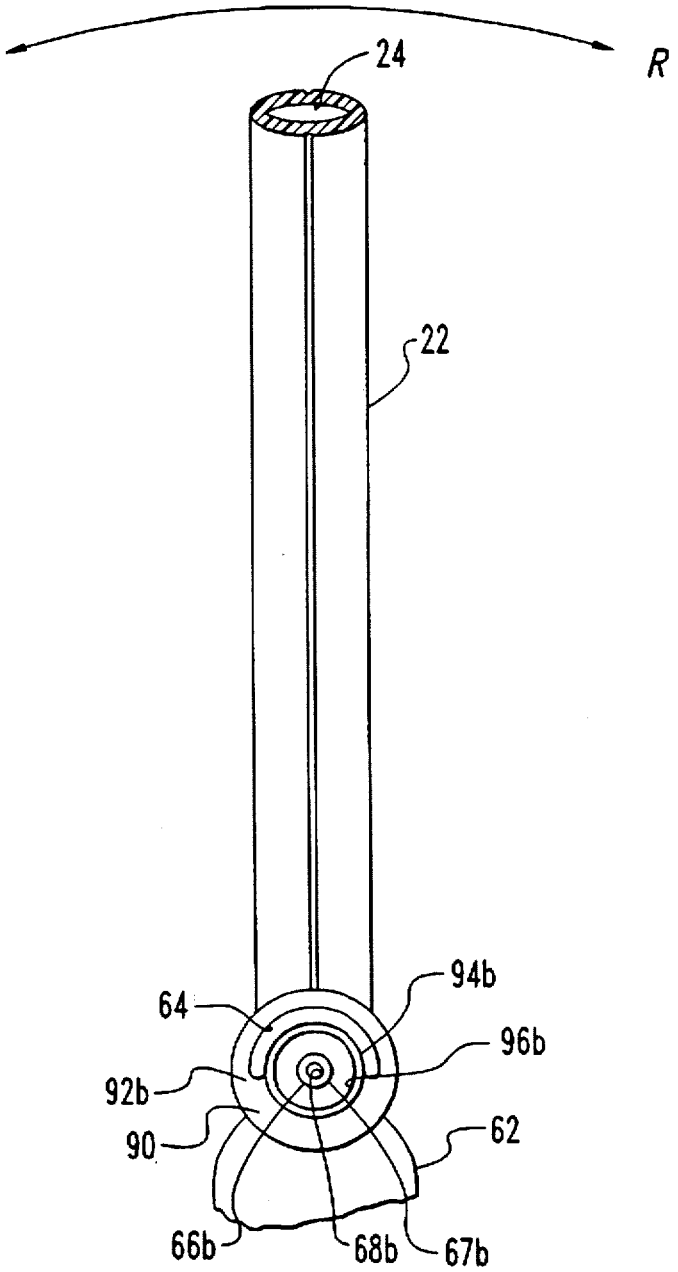
FIG. 4 is a partial sectional side view of the embodiment shown in FIGS. 1 and 2.

Additionally referring to the partial sectional view of FIG. 4, each opposing surface 92*a*, 92*b* defines annular lip 94*a*, 94*b*. Annular lip 94*a*, 94*b* defines annular recess 96*a*, 96*b* which is configured to receive flange portion 72*a*, 72*b* of resilient bearing member 70*a*, 70*b*, correspondingly.

Having described the structure, operation of antenna assembly 10 as an antenna orienting device is next discussed. Generally, it should be noted that antenna structure 20 and each dipole antenna 50*a*, 50*b* are capable of multi-axial rotational positioning with respect to base 40. For dipole antenna 50*a*, arm 52 rotates about an axis along the length of screw 58. This axis is generally perpendicular to the view plane of FIG. 1. The clamping force of clevis 56 necessary to hold arm 52 in a desired rotational position about this axis may be adjusted by tightening or loosening screw 58. The range of rotational positioning of arm 52 is at least 180 degrees. Furthermore, base 54 is configured to rotate about a generally vertical axis along its length. Notably, the range of rotational positioning of base 54 is 360 degrees. Dipole antenna 50*b* has the same multi-axial rotational positioning capability. As such, each dipole antenna 50*a*, 50*b* is configured to rotate about two generally perpendicular axes. Rotational adjustments of either dipole antenna 50*a*, 50*b* may be performed by hand.

As previously noted, support body 62 rotates about axis V to provide antenna structure 20 a first rotational axis which may be adjusted by grasping body 62 and turning it by hand. The range of rotation about axis V is limited to about 350 degrees due to the integration of a stopper in support body 62 or base 40. This limitation prevents damaging either lead portion 28*a* or 28*b* of antenna wire 26 as might occur if rotation about axis V was unrestricted. In other embodiments, it is envisioned that this limitation would not be required, permitting a full 360 degrees of rotation. Coupling support 60 provides for rotational positioning of antenna structure 20 about substantially non-vertical axis H. As used herein, a "substantially non-vertical axis" is an axis which deviates from vertical by at least 10 degrees. Additionally referring to FIG. 4, a rotational path R of antenna structure 20 is shown. Axis H shown in FIGS. 1 and 2 is generally perpendicular to view plane of FIG. 4. Notably axis V and axis H are generally mutually perpendicular. Antenna structure 20 may be adjusted by grasping conduit 22 and moving it by hand to a desired position. In one preferred embodiment, the range of available rotational positions spans at least 45 degrees. In a more preferred embodiment, the range spans at least 90 degrees. In a most preferred embodiment, the range is at least 180 degrees.

Because axis H is substantially non-vertical, the force exerted on antenna structure 20 from the Earth's gravitational field will vary with the selected rotational position thereabout. For the antenna structure 20 position shown in FIGS. 1 and 2, the adverse impact of the Earth's gravitational pull on a coupling assembly is negligible. However, as the antenna structure is rotated further away from this position about the H axis, the more strongly the coupling assembly must counteract the Earth's gravitational pull to retain the antenna structure's position. Moreover, the shape of antenna structure 20 presents a center of gravity which is at least more than one third the distance between axis H to the opposing end of antenna structure 20. Reliably retaining antenna structure 20 in any one of a range of rotational positions about axis H presents a significant challenge—especially when the antenna structure will be repeatedly adjusted by hand. Even more challenging, is providing a smooth and continuous hand selectable range of rotational positions which may be changed time and time again.

Referring back to FIG. 3A, one way of simply and cost effectively solving these problems is discussed. Specifically, the rotatable fastening of mounting tabs 30*a*, 30*b* to coupling support 60 provides one solution. Each screw 80*a*, 80*b* is threaded into a corresponding threaded bore 68*a*, 68*b*, to adjustably clamp washers 82*a*, 82*b*, mounting tabs 30*a*, 30*b*, and resilient bearing members 70*a*, 70*b* between each head 84*a*, 84*b* and central member portion 90, respectively. This clamping holds each mounting tab 30*a* and 30*b* in place by opposing forces exerted between various surfaces being held in a rotary bearing relationship to each other. These forces may be overcome by moving antenna structure 20, and in turn rotating mounting tabs 30*a*, 30*b* by hand. After such movement, the forces retain the mounting tabs in the new rotational position even if the new position is more adversely effected by the earth's gravitational pull on the antenna structure 20 as compared to the original position.

In one preferred embodiment, retaining forces necessary to hold antenna structure 20 despite changing adverse conditions are obtained by elastically deforming resilient bearing members 70*a*, 70*b*. As each screw 80*a*, 80*b* is tightened, resilient bearing members 70*a*, 70*b* are compressed and deformed. As long as resilient bearing members 70*a*, 70*b* are not deformed beyond their elastic limit, the resilient bearing members 70*a*, 70*b* try to return to their shape prior to deformation. A rebound force from resilient bearing members 70*a*, 70*b* results against corresponding bearing surfaces which are imparting the deforming forces. When static, theses forces tend to resist rotational movement of antenna structure 20 despite varying countervailing forces from Earth's gravitational pull. However, these forces may be overcome when adjusting the antenna structure 20. Moreover, the retaining forces offered by the deformation of resilient bearing members 70*a*, 70*b* reliably hold the antenna structure in the new position without the need to adjust screws 80*a*, 80*b*. Nonetheless, as parts wear or loosen, screws 80*a*, 80*b* can be adjusted to regain any lost retention capability.

One example of surfaces held in a rotary bearing relation by these retaining or holding forces include inner contact surface 32*a*, 32*b* of mounting tab 30*a*, 30*b* which are correspondingly held in rotary bearing relation to flange surfaces 73*a*, 73*b*. Besides these bearing surfaces, each outer contact surface 36*a*, 36*b* is correspondingly held in rotary bearing relation to resilient bearing member end faces 76*a*, 76*b*. Another bearing surface relationship is maintained between outer circumferential surface 75*a*, 75*b* and inner circumferential surface 34*a*, 34*b*. Notably, the compression of resilient bearing member 70*a*, 70*b* also tends to expand barrel portion 74*a*, 74*b* radially which generates retaining forces between outer circumferential surface 75*a*, 75*b* and inner circumferential surface 34*a*, 34*b*. Thus, an ability to vary holding forces for a given orientation of antenna structure 20 is provided by adjustment of screws 80*a*, 80*b*, assuming that a generally constant coefficient of friction is maintained between the rotary bearing surfaces.

Each resilient bearing member 70*a*, 70*b* is a type of non-metallic resilient bearing member which avoids the problems introduced by using metallic springs in an antenna coupling device. In other embodiments of the present invention, the resilient bearing member may be variously shaped and may include metallic materials. In one alternate embodiment, a plurality of resilient bearing members in the form of pads are attached along stems 66*a* , 66*b* or on opposing surfaces 92*a*, 92*b* may be used. In still another embodiment, a semi-circular resilient bearing member is used with or without a flange.

In other embodiments other types of fasteners besides screws 80*a*, 80*b* may be used to hold the mounting tabs 30*a*, 30*b* in a rotary bearing relationship with a resilient bearing member. For example, in one alternative embodiment, stems carrying the resilient bearing member are configured with a threaded end that protrudes through the washer and engages a nut in place of the screw head. In this embodiment, the mounting tabs 30*a*, 30*b*, resilient bearing members 70*a*, 70*b*, and washer 82*a*, 82*b* are clamped between the nut and central member portion 90. In embodiments not requiring adjustable clamping a rivet fastener could be use in place of adjustable screws 80*a*, 80*b*. Other fasteners as are known to those skilled in the art are also contemplated.

In some alternate embodiments, the washers 82*a*, 82*b* are not required. In other embodiments, it is envisioned that more or less mounting tabs, resilient bearing members, stems, and fasteners may be used as would occur to one skilled in the art.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An antenna orientation device, comprising:

a base;

an antenna structure with a first bearing surface; a support for positioning said structure in relation to said base, said support including:

a body coupled to said base, said body having a first stem;

a resilient non-metallic first bearing member carried on said first stem, said first bearing member having a second bearing surface; and a first fastener connected to said body, said first fastener clamping said first and second bearing surfaces in rotary bearing relation, said first bearing member being elastically deformed to provide retaining force sufficient to hold said structure against earth's gravitational pull in any one of a range of rotational positions about a substantially non-vertical axis, and each position within said range being selectable by rotating said structure by hand.

2. The device of claim 1, wherein said antenna structure includes:

a conductive wire antenna with a first lead portion and a second lead portion; and a hollow non-conductive tube enclosing and supporting said antenna in a loop shape, said tube having a first mounting tab with said first bearing surface.

3. The device of claim 2, wherein said tube has a second mounting tab with a third bearing surface, and said support further includes:

a second stem attached to said body opposite said first stem;

a resilient non-metallic second bearing member carried on said second stem, said second bearing member having a fourth bearing surface; and a second fastener connected to said body, said second fastener clamping said third and fourth bearing surfaces in a rotary bearing relationship, said second member being elastically deformed by said second fastener to further provide retaining force to hold said structure in any one of said range of rotational positions.

4. The device of claim 1, wherein said first bearing member has a cylindrical shape with a barrel portion and a radially projecting flange portion, said barrel portion defines a bore receiving said first stem, and said body defines a recess receiving said projecting flange portion.

5. The device of claim 4, wherein:

said second bearing surface is along a face of said flange portion;

said structure includes a mounting tab with said first bearing surface defining an opening, said opening having an inner circumferential bearing surface;

said first bearing member having an outer circumferential bearing surface about said barrel portion; and said first fastener further clamping said inner and outer circumferential bearing surfaces in a rotary bearing relationship, said first bearing member being elastically deformed by said first fastener to provide radial forces to further hold said structure in any one of said range of available rotational positions.

6. The device of claim 4, wherein said first stem has an end surface defining a threaded bore and said first fastener includes a screw threaded into said bore to connect said first fastener to said body.

7. The device of claim 1, wherein said first fastener is adjustable to control elastic deformation of said first bearing member and correspondingly adjust retaining force.

8. The device of claim 1, wherein said substantially non-vertical axis is generally horizontal, said body is rotably connected to said base for selectively rotating said support at least 180 degrees about a generally vertical axis, and said range is at least 180 degrees.

9. A device for orienting an antenna in a selected position, comprising:

a base;

an antenna structure including a first mounting tab defining an first opening therethrough;

a support for positioning said structure in relation to said base, said support including:

a body coupled to said base;

a resilient non-metallic first member; and a first fastener having a first stem with opposing ends, one of said opposing ends being attached to said body and the other of said opposing ends having a first head, said first stem being received through said first opening, and said first fastener clamping said first member and said first mounting tab between said first head and said body, said fastener elastically deforming said first member to provide retaining force sufficient to hold said structure against earth's gravitational pull in any one of a range of rotational positions about a substantially non-vertical axis, and each position within said range being selectable by rotating said structure by hand.

10. The device of claim 9, wherein said structure includes a second mounting tab defining a second opening, said second opening being generally aligned with said first opening along said substantially non-vertical axis, and further comprising:

a resilient non-metallic second member; and a second fastener having a second stem with opposing ends, one of said opposing ends being attached to said body and the other of said opposing ends having a second head, said second stem being received through said second opening, and said second fastener clamping said second member and said second mounting tab between said second head and said body, said fastener elastically deforming said second member to further provide retaining force for holding said structure in a position selected from said range.

11. The device of claim 10, wherein said substantially non-vertical axis is generally horizontal, said body is rotably connected to said base for selectively rotating said support at least 180 degrees about a generally vertical axis, and said range is at least 180 degrees.

12. The device of claim 9, wherein said antenna structure includes:

a conductive wire antenna with a first lead portion and a second lead portion; and a hollow non-conductive tube enclosing and supporting said antenna in a loop shape.

13. The device of claim 9, further comprising a washer disposed about said first stem and contacting said first head.

14. The device of claim 9, further comprising a plurality of telescopic dipole antennae coupled to said base.

15. The device of claim 9, wherein said fastener is adjustable to control elastic deformation of said first bearing member and correspondingly adjust retaining force.

16. An antenna assembly, comprising:

a base;

a conductive wire antenna with a first lead portion and a second lead portion;

a hollow non-conductive conduit supporting said wire in a loop shape, said conduit having a mounting tab;

a support for selectively orienting said conduit relative to said base, said support having:

a first rotary connection to said base for selective rotation of said support about a first axis;

a second rotary connection to said mounting tab for selective rotation of said conduit about a second axis, said first axis being generally perpendicular to said second axis;

wherein said second rotary connection includes a fastener and a bearing member, said fastener being adjustable to control elastic deformation of said bearing member and correspondingly adjust retaining force.

17. The assembly of claim 16, wherein said base defines a pathway from said conduit to said base, said pathway receiving said first and second lead portions for passage to said base.

18. The assembly of claim 17, further comprising an electronic circuit electrically coupled to said antenna, said circuit for processing signals from said antenna.

19. The assembly of claim 18, wherein said base defines a cavity, said circuit includes at least one component mounted on a circuit board housed within said cavity, and said first and second lead portions are connected to said board.

20. The assembly of claim 16, wherein said first axis is generally vertical and said second axis is generally horizontal.

21. The assembly of claim 20, wherein said first rotary connection provides at least 180 degrees of rotation and said second rotary connection provides at least 180 degrees of rotation.

22. The assembly of claim 16, wherein said conduit is a tube substantially enclosing said antenna.

23. The assembly of claim 16, further comprising a plurality of dipole antennas coupled to said base.

24. An antenna orientation device, comprising:

a base;

a loop antenna structure with a first mounting tab;

a support for positioning said structure in relation to said base, said support including:

a body coupled to said base;

a resilient non-metallic first bearing member; and a first fastener connected to said body, said first fastener maintaining said first mounting tab and said first bearing member in rotary bearing relation, said first bearing member being elastically deformed to provide retaining force sufficient to hold said structure against earth's gravitational pull in any one of a range of rotational positions about a substantially non-vertical axis, said range being at least 45 degrees, and each position within said range being selectable by rotating said structure by hand.

25. The device of claim 24, further comprising:

a second mounting tab connected to said structure;

a resilient non-metallic second bearing member; and a second fastener connected to said body, said second fastener maintaining said second mounting tab and said second bearing member in rotary bearing relation, said second bearing member.

26. The device of claim 24, wherein said range is at least 90 degrees.

27. The device of claim 24, wherein said range is at least 180 degrees.

28. The device of claim 24, wherein said structure has a center of gravity located along a pivoting axis, said pivoting axis is generally perpendicular to said substantially non-vertical axis, said center of gravity is offset from said substantially non-vertical axis by at least one third of the distance between said substantially non-vertical axis and an end of said structure along said pivoting axis.

29. The device of claim 28, wherein said substantially non-vertical axis is generally horizontal.

30. The device of claim 24, wherein said antenna structure includes:

a conductive wire antenna with a first lead portion and a second lead portion; and a hollow non-conductive tube enclosing and supporting said antenna in a loop shape.

31. The device of claim 25, wherein said first fastener is adjustable to control elastic deformation of said first bearing member and correspondingly adjust retaining force.

32. The device of claim 24, wherein said substantially non-vertical axis is generally horizontal, said body is rotably connected to said base for rotating said support at least 180 degrees about a generally vertical axis, and said range is at least 180 degrees.

* * * * *